US005680787A

United States Patent [19]

Fisch

[11] Patent Number: 5,680,787

[45] Date of Patent: Oct. 28, 1997

[54] INDEXING CONVEYOR FOR A DIE TRANSFER SYSTEM

[75] Inventor: Alfred C. Fisch, Clarkston, Mich.

[73] Assignee: Rapindex Incorporated, Bloomfield Hills, Mich.

[21] Appl. No.: 549,329

[22] Filed: Oct. 27, 1995

[51] Int. Cl.[6] ..... B21D 43/05

[52] U.S. Cl. ..... 72/405.16; 72/405.09; 198/621.3

[58] Field of Search ..... 72/405.16, 405.11–405.13, 72/405.01; 198/621.3, 621.1

[56] References Cited

U.S. PATENT DOCUMENTS

| | | | |
|---|---|---|---|
| Re. 34,581 | 4/1994 | Sofy | 72/405.16 |
| 5,035,134 | 7/1991 | Fisch | 72/405 |
| 5,136,874 | 8/1992 | Fisch | 72/405.12 |
| 5,390,525 | 2/1995 | Fisch | 72/405 |

FOREIGN PATENT DOCUMENTS

| | | | |
|---|---|---|---|
| 185164 | 7/1993 | Japan | 72/405.01 |

*Primary Examiner*—Daniel C. Crane

*Attorney, Agent, or Firm*—Barnes, Kisselle, Raisch, Choate, Whittemore & Hulbert

[57] ABSTRACT

A die transfer system that includes a lower die, an upper die carried for reciprocal movement toward and away from the lower die to perform at-least one operation on a workpiece positioned therebetween, and a conveyor arrangement for sequentially conveying workpieces between the dies. The conveyor arrangement includes a camshaft having an axis of rotation parallel to the direction of movement of workpieces through the die system, a transfer bar parallel to the camshaft axis carrying a plurality of hands for engaging the workpieces, and a cam arrangement coupling the camshaft to the transfer bar for moving the transfer bar both horizontally and vertically orthogonal to the camshaft axis. The cam arrangement includes a cam arm coupled to the camshaft and having a pair of angularly spaced drive rollers mounted thereon. Separate horizontal and vertical cam follower slots are disposed adjacent to the cam arm for sequential driving engagement by the rollers on the cam arm, such that rotation of the camshaft and cam arm brings the rollers into sequential engagement with the cam follower slots for driving the transfer bar horizontally and vertically with respect to the lower die.

12 Claims, 7 Drawing Sheets

INDEXING CONVEYOR FOR A DIE TRANSFER SYSTEM

The present application is directed to die transfer systems, and more particularly to an improved conveyor for indexing workpieces through successive stations of the die assembly.

BACKGROUND AND OBJECTS OF THE INVENTION

In so-called progressive die systems, workpieces formed from strip stock remain attached to webs that extend along lateral edges of the pieces to facilitate indexing of the workpieces through successive stages of the die assembly. Although such arrangements facilitate conveyance of workpieces through the die stations, they possess the disadvantage that the workpiece must be formed in a linear array ai spaced locations along the strip stock, leading to substantial inefficiency and waste. Furthermore, the fact that all workpieces remain interconnected during at least a major portion of the die operation can lead to difficulty and inefficiency in performing operations on the workpieces at a given station. For these reasons and others, so-called die transfer systems have been developed in which the workpieces are preseparated and fed as individual units of the die arrangement. A die transfer system of this character permits more efficient use of the strip stock material, and also permits greater flexibility in operations that can be performed at the individual die stations. However, the conveyor arrangement for indexing individual workpieces through a die transfer system is more complex than those in typical progressive die systems, usually involving release and reengagement with the workpieces at each of the individual die stations.

U.S. Pat. No. 5,136,874, assigned to the assignee hereof, discloses a die transfer system that includes a lower die, an upper die carried for reciprocal vertical movement toward and away from the lower die to perform at least one operation on a workpiece positioned therebetween, and a conveyor arrangement for sequentially conveying workpieces between the dies. The conveyor arrangement has a pair of conveyors disposed on opposite lateral sides of the lower die. Each conveyor includes a plurality of hands for gripping workpieces, with the hands being spaced from each other lengthwise of the conveyor by distances corresponding to stations of the die. Each conveyor and its associated hands are indexed in a longitudinal direction through the die between stations in synchronism with motion of the upper die. The hands are moved simultaneously in at least one direction perpendicular to the longitudinal indexing direction by a camshaft that extends through the stations along an axis parallel to the indexing direction. A cam is mounted on each camshaft for rotation with the camshaft in synchronism with motion of the upper die. A follower arrangement couples each cam to the hands of the associated conveyor, so that reciprocal rotation of the camshaft about its axis results in reciprocal motion of the hands in one or more directions lateral to the longitudinal direction of conveyance of workpieces through the die stations. The conveyor camshafts are rotated by cam-and-follower arrangements coupled to the upper die, or by electric servo motors controlled by a master controller.

Although the die transfer system and indexing conveyor arrangement disclosed in the noted patent address and overcome problems and deficiencies theretofore extant in the art, further improvements remain desirable. It is a general object of the present invention to provide an indexing conveyor for a die transfer system of the type disclosed in the noted patent in which the mechanism for obtaining horizontal and vertical movement orthogonal to the indexing direction is of simplified and more economical construction than that disclosed in the noted patent. Another object of the present invention is to provide a transfer system of the described character in which the transfer mechanism has improved strength and rigidity in the lowered position, and in which improved control of the individual motions is obtained.

SUMMARY OF THE INVENTION

A die transfer system in accordance with the present invention includes a lower die, an upper die carried for reciprocal movement toward and away from the lower die to perform at least one operation on a workpiece positioned therebetween, and a conveyor arrangement for sequentially conveying workpieces between the dies. The conveyor arrangement includes a camshaft having an axis of rotation parallel to the direction of movement of workpieces through the die system, a transfer bar parallel to the camshaft axis carrying a plurality of hands for engaging the workpieces, and a cam arrangement coupling the camshaft to the transfer bar for moving the transfer bar both horizontally and vertically orthogonal to the camshaft axis. The cam arrangement includes a cam arm coupled to the camshaft and having a pair of angularly spaced drive rollers mounted thereon. Separate horizontal and vertical cam follower slots are disposed adjacent to the cam arm for sequential driving engagement by the rollers on the cam arm, such that rotation of the camshaft and cam arm brings the rollers into sequential engagement with the cam follower slots for driving the transfer bar horizontally and vertically with respect to the lower die.

The cam arrangement in the preferred embodiment of the invention includes a fixed support, and separate horizontal and vertical carriages carried by the support for horizontal and vertical motion respectively. The separate horizontal and vertical cam follower slots are coupled to the horizontal and vertical carriages such that motion of one of the drive rollers through the vertical slot drives the horizontal carriage horizontally with respect to the lower die, and motion of the other drive roller through the horizontal slot drives the vertical carriage vertically with respect to the lower die. In the preferred embodiment of the invention, the horizontal and vertical carriages are disposed parallel to each other, one of the carriage being mounted to the fixed support by first linear bearings and the other of the carriages being mounted to the one carriage by second linear bearings orthogonal to the first linear bearings.

The horizontal and vertical carriages in the preferred embodiment of the invention are coupled to each other and to the fixed support such that motion of one of the rollers through the vertical slot drives both of the carriages horizontally, while motion of the other roller through the horizontal slot drives the vertical carriage vertically with respect to both the horizontal carriage and the support. The vertical carriage includes a bar for engaging a roller mounted to the support to prevent horizontal motion during vertical motion of the vertical carriage. The vertical slot includes separate opposed slot sections respectively disposed on the vertical carriage and coupled to the horizontal carriage, such that motion of the one drive roller through the vertical slot in one direction drives the horizontal carriage directly, while motion of the drive roller through the vertical slot in the other direction drives the horizontal carriage through the vertical carriage and one of the linear bearings.

A tooling carriage is supported by one of the horizontal and vertical carriages, and the transfer bar is mounted for longitudinal motion on the tooling carriage parallel to the camshaft axis. The conveyor further includes a transfer mechanism operatively coupled to the transfer bar for moving the transfer bar longitudinally parallel to the camshaft axis. The transfer mechanism is coupled to the transfer bar by a slider arm for driving the transfer bar longitudinally while accommodating both horizontal and vertical motion of the transfer bar orthogonal to the camshaft axis.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENT

Figure 1:
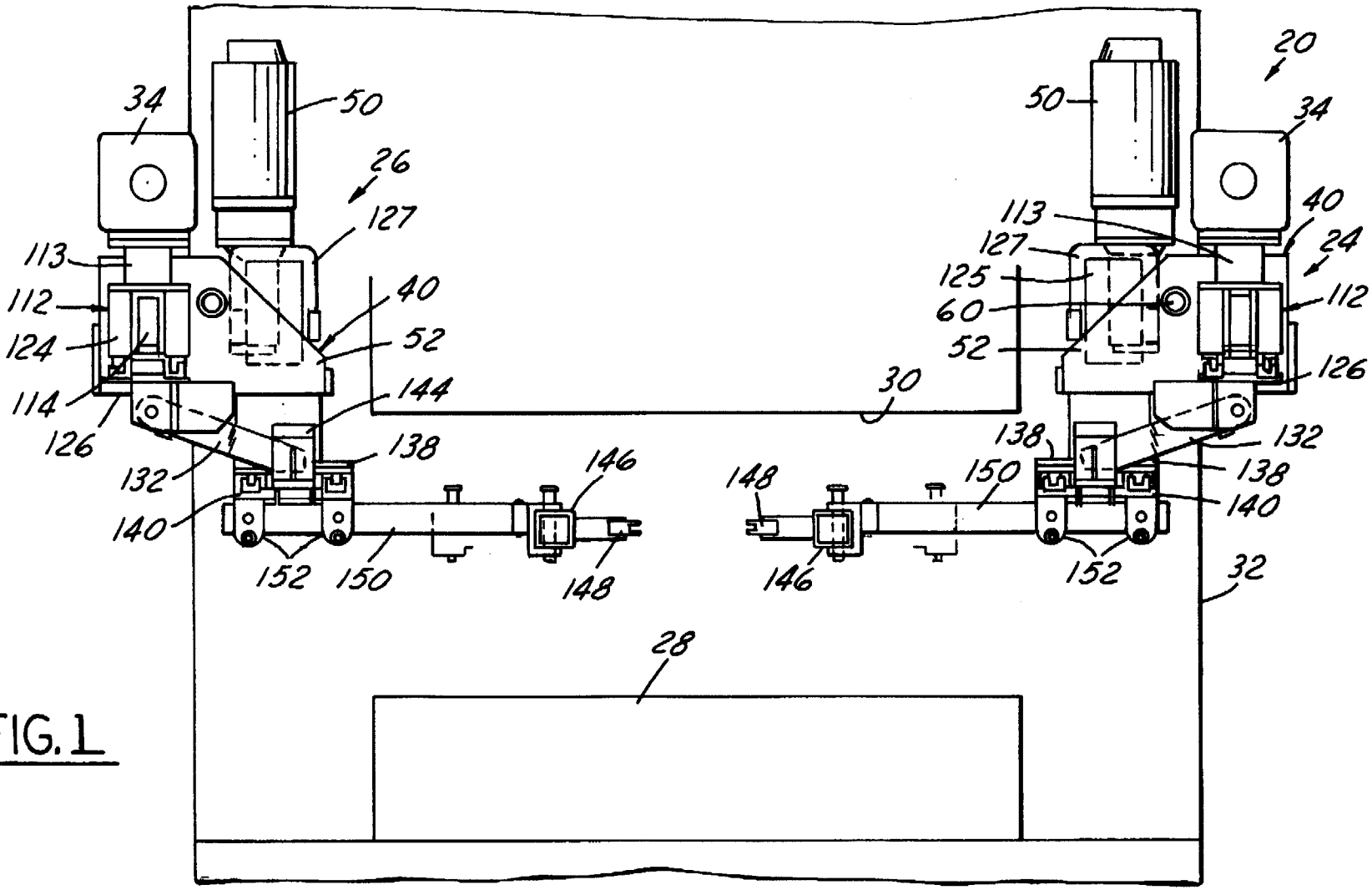
FIG. 1 is an end elevational view of a die transfer system in accordance with a presently preferred embodiment of the invention.
Figure 2:
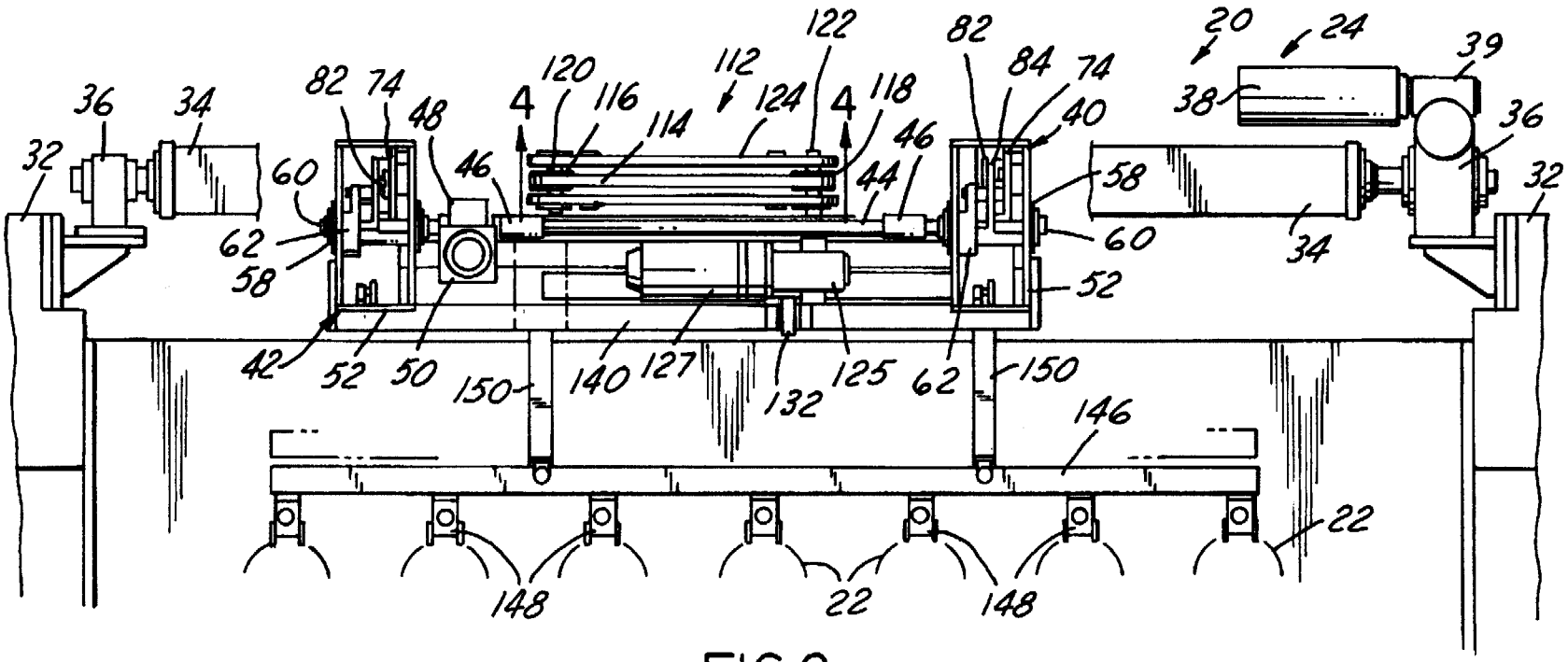
FIG. 2 is a top plan view of one of the conveyors illustrated in FIG. 1, the other conveyor in FIG. 1 being a mirror image of the conveyor illustrated in FIG. 2.

FIGS. 1 and 2 illustrate a die transfer system 20 in accordance with a presently preferred embodiment of the invention for indexing workpieces 22 through successive stations of a workpiece die. A pair of workpiece conveyors 24, 26 are positioned on laterally opposed sides of a lower die 28, and an upper die 30 is carried by a press support base 32 for vertical reciprocation with respect to lower die 28. In general, conveyors 24, 26 cooperate with the upper and lower dies to define a workpiece load station at an upstream end of the conveyors, an unload station at the downstream end of the conveyors, and one or more workstations positioned therebetween at which desired operations are performed at each workpiece 22 upon descent of the upper die. Details of the dies, the geometry of the workpieces and operations performed thereon by the dies are not directly germaine to the present invention. In general, the constructions of conveyors 24, 26 are mirror images of each other. (For some workpieces, only one conveyor 24 is required, and in other situations conveyor 24 may cooperate with another type of transfer mechanism.) The preferred embodiment of the invention will be described in detail in conjunction with conveyor 24.

Conveyor 24 includes a support beam 34 that is carried in fixed position relative to support base 32, such as by being mounted on the support base, the press bolster, the press bed or the plant floor adjacent to the press. Support beam 34 is pivotally mounted between opposed bearings 36, and is coupled to a motor 38 by a gear box 39 for swinging support beam 34, and conveyor 24 carried thereby, upwardly and outwardly with respect to lower die 28 for operator access to the lower die and/or conveyor. Such construction is disclosed in U.S. Pat. No. 5,390,525 assigned to the assignee hereof. Alternatively, conveyor 24 may be mounted on a wheeled cart as disclosed in U.S. application Serial No. 08/368,434, or may be fixedly mounted to the support base as disclosed in above-noted U.S. Pat. No. 5,136,874, both assigned to the assignee hereof.

Figure 9:
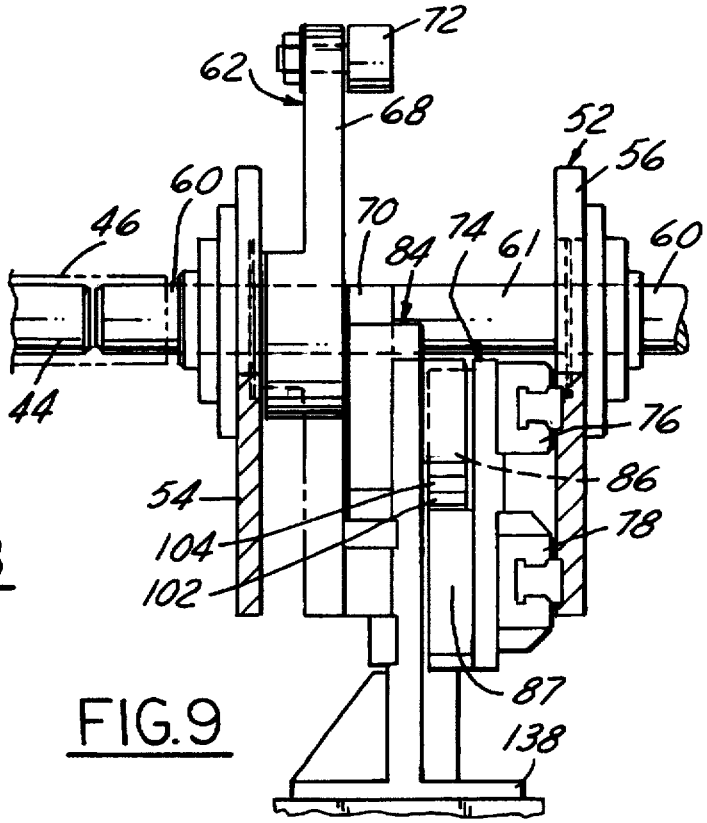
FIG. 9 is a sectional view taken substantially along the line 9—9 in FIG. 7.

Two or more cam housing assemblies 40, 42 are longitudinally spaced from each other and suspended from support beam 34. Cam housings 40, 42 are interconnected by a camshaft 44 and a pair of camshaft couplings 46 (FIGS. 2 and 9). Camshaft 44 is connected by a gear box 48 to an electric motor 50 for cyclically operating camshaft 44 as will be described. Referring in particular to FIGS. 3 and 6–10, cam housings 40, 42, which are identical to each other, include a support frame 52 suspended from beam 34. Support frame 52 includes opposed parallel side walls 54, 56, each of which carries a bearing 58 that rotatably supports a split stub shaft 60. The split ends of stub shaft 60, which are received in axially aligned bearings 58, are interconnected by off-axis shaft 61 (FIGS. 6–7 and 9–10), which is parallel to but offset from the axis of shaft 60. Shaft 60 forms an extension of camshaft 44, being connected thereto by coupler 46 (FIGS. 2 and 9). Thus, as camshaft 44 is rotated by motor 50 (FIG. 2), split shaft 60 rotates conjointly therewith, and off-axis shaft 61 orbits around the axis of shaft 60.

Figure 6:
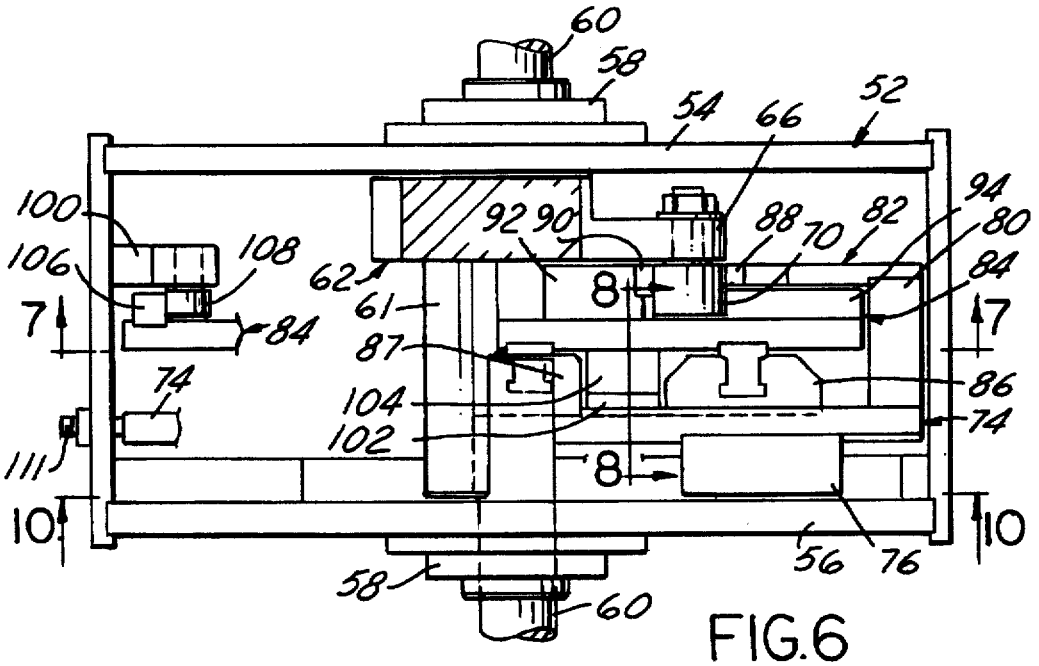
FIG. 6 is a top plan view on an enlarged scale of one of the cam housings illustrated in FIGS. 2 and 3, being taken substantially along the line 6—6 in FIG. 3.
Figure 10:
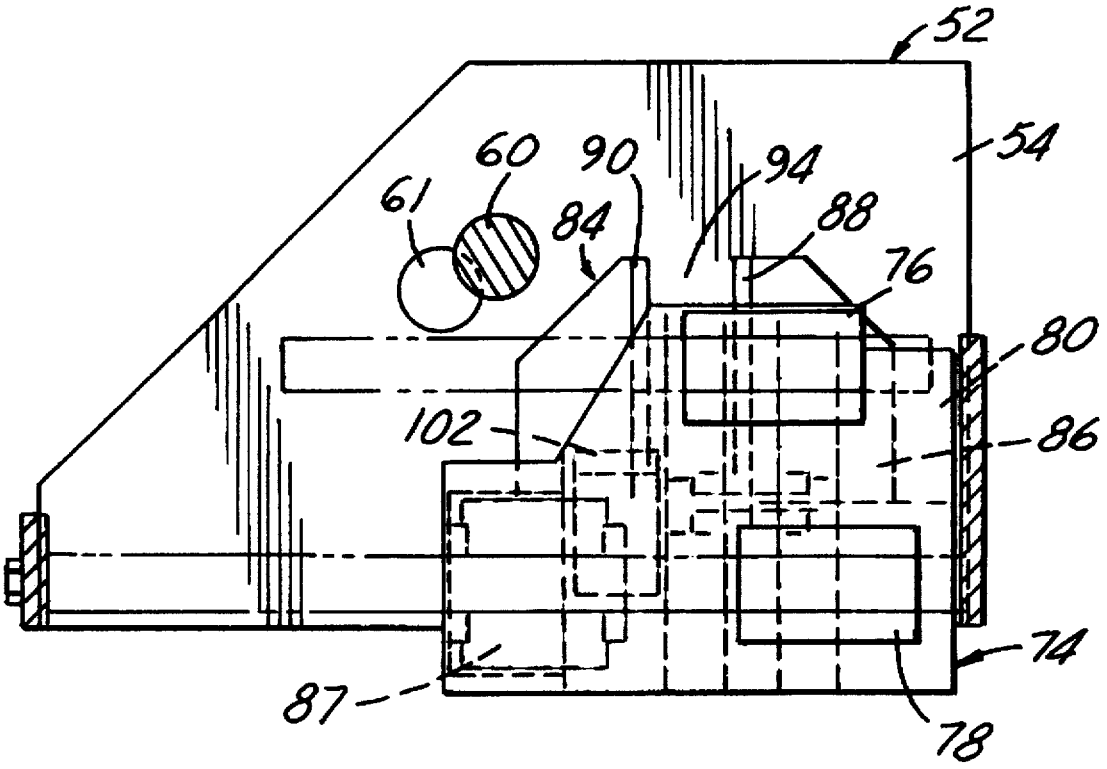
FIG. 10 is a sectional view taken substantially along the line 10—10 in FIG. 6.

Within support frame 52, a cam arm 62 (FIGS. 2, 6–7 and 9) is coupled to shafts 60 and 61 to rotate about the axis of stub shaft 60. Arm 62 has a pair of angularly spaced radially extending arm segments 66, 68, at the outer end of each of which is mounted a cam drive roller 70, 72 respectively. A horizontal carriage 74 (FIGS. 2 and 6–10) is mounted to wall 56 of frame 52 by a pair of vertically spaced horizontally oriented linear bearings 76, 78 (FIGS. 6, 9 and 10). Horizontal carriage 74 is affixed by a bridge 80 (FIGS. 6 and 7) to a cam plate 82 (FIGS. 6 and 7) disposed adjacent to arm 62. Thus, horizontal carriage 74, bridge 80 and cam plate 82 are carried by frame 52 for motion as a unit horizontally along linear bearings 76, 78. A vertical carriage 84 (FIGS. 2 and 6–10) is disposed between horizontal carriage 74 and cam plate 82, and is mounted to horizontal carriage 74 by a pair of horizontally spaced vertically extending linear bearings 86, 87 (FIGS. 6 and 9). Thus, vertical carriage 84 moves horizontally as a unit with horizontal carriage 74, bridge 80 and cam plate 82, and moves vertically along linear bearings 86, 87 independently of horizontal carriage 74.

A wear plate 88 (FIGS. 6–7 and 10) extends vertically along an edge of cam plate 82 at a radius from stub camshaft 60 corresponding to the radius of cam drive roller 70. A second wear plate 90 is carried by a block 92 (FIG. 6) mounted on vertical carriage 84 adjacent to arm 62 in such a way that wear plates 88, 90 are parallel and opposed to each other in a common plane, forming therebetween a vertical cam follower slot 94 at a radius from stub camshaft 60 for receipt of cam drive roller 70. A pair of parallel wear bars 94, 96 (FIGS. 6–7) are fastened by screws 98 on vertical carriage 84 on the side of carriage 84 adjacent to arm 62, and at a position with respect to the axis of stub camshaft 60 to receive cam drive roller 72. Cam arm portions 66, 68 and cam drive rollers 70, 72 operate in a single plane, but at differing radii from the axis of stub camshaft 60 in the illustrated embodiment. Thus, wear bars 94, 96 form a horizontal cam follower slot 100 for receipt of cam drive roller 72, as will be described. Wear bars 94, 96 lie in a plane that is laterally offset from the plane of wear plates 88, 90, as best seen in FIG. 6, so that wear plates 88, 90 are engaged by an edge of roller 70 adjacent to arm 62, while wear bars 94, 96 are engaged by an edge of roller 72 spaced from arm 62.

A pair of stop members 102, 104 (FIGS. 6–10) are respectively mounted on horizontal carriage 74 and vertical carriage 84 between vertical linear bearings 86, 87. Stop members 102, 104 vertically overlie each other, and are positioned for engagement in the lowered position of vertical carriage 84, such that vertical carriage 84 is supported by horizontal carriage 74 in this position. A vertically oriented stop bar 106 (FIGS. 6 and 7) is mounted by screws 107 along the lower forward edge of vertical carriage 84. Stop bar 106 is positioned to cooperate with a roller 108 carried by an arm 110 of frame 52 (FIGS. 6 and 7) to prevent horizontal movement of vertical carriage 84 with respect to frame 52 during vertical motion of the vertical carriage. An adjustable stop 111 (FIG. 6) is carried by frame 52 adjacent to arm 110 for abutment by horizontal carriage at the fully forward or inward position of the latter.

Figure 4:
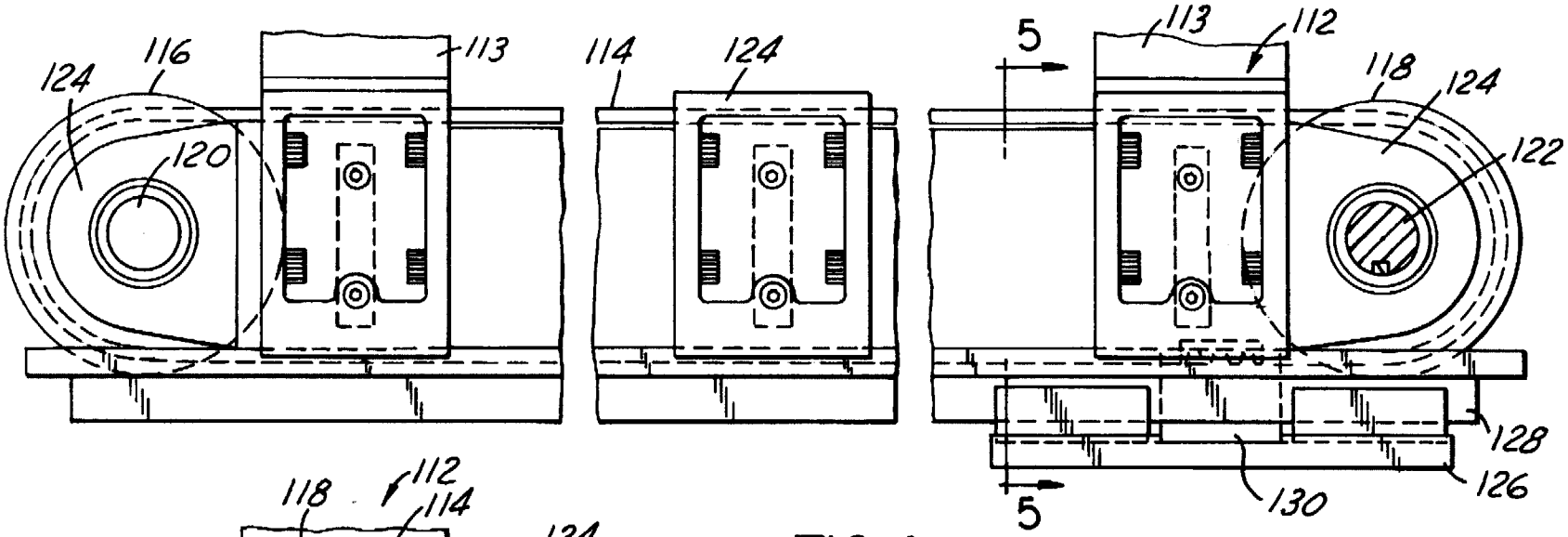
FIG. 4 is a sectional view taken substantially along the line 4—4 in FIG. 2.
Figure 5:
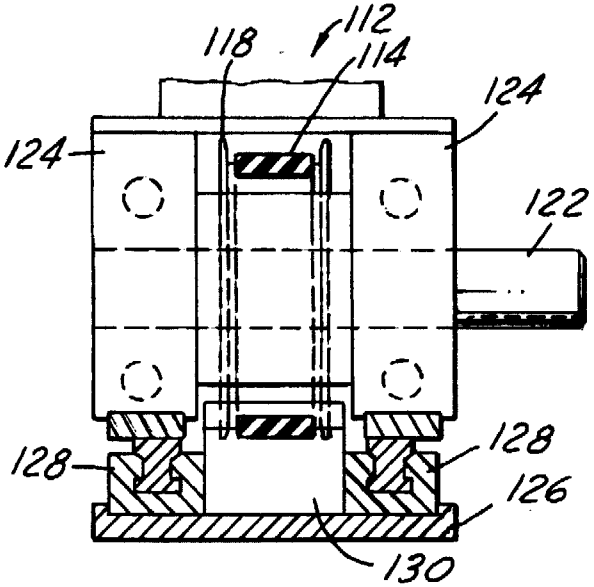
FIG. 5 is a sectional view taken substantially long the line 5—5 in FIG. 4.
Figure 7:
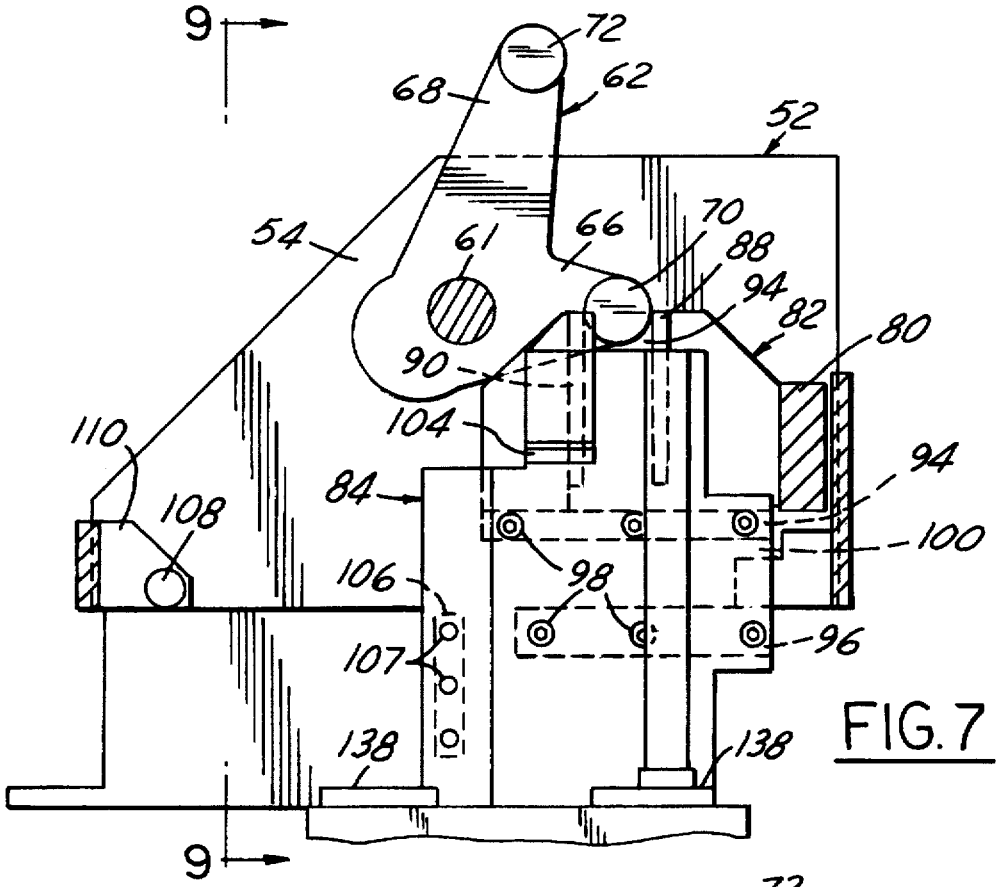
FIGS. 7 and 8 are sectional views taken substantially along the respective lines 7—7 and 8—8 in FIG. 6.
Figure 8:
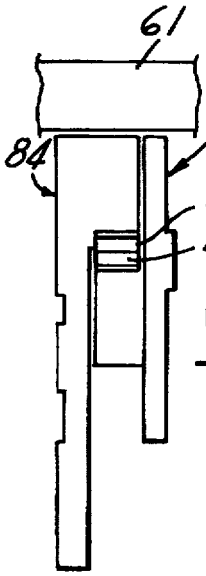

An indexing conveyor drive 112 (FIGS. 1–5) is suspended beneath support beam 24 by longitudinally spaced hangers 113. Indexing conveyor drive 112 comprises an endless belt 114 trained around a pair of longitudinally spaced pulleys 116, 118. Pulleys 116, 118 are mounted on rotatable shafts 120, 122, which are themselves mounted at fixed spacing by a indexing conveyor frame 124. Shaft 122 is connected to a gear box 127 driven by an electric motor 125 (FIGS. 1–3) for reciprocating conveyor 112 and indexing workpieces, as will be described. A transfer carriage 126 (FIGS. 1, 3 and 4) is mounted to frame 124 by linear bearings 128 that extend in the longitudinal direction parallel to the axis of camshaft 44. Transfer carriage 126 is coupled by a bracket 130 (FIGS. 4 and 5) to indexing conveyor drive belt 114 for longitudinal motion conjointly with the indexing conveyor drive. An arm 132 (FIGS. 1–3) is coupled to transfer carriage 126 by a pin 134 so that arm is free to pivot vertically, but restrained from horizontal motion with respect to carriage 126. The lowermost position of arm 32 is defined by a stop 136 carried by the transfer carriage.

Each vertical carriage 84 extends downwardly to form parallel horizontally extending feet 138 (FIGS. 1, 3, 7 and 9). A tooling carriage 140 (FIGS. 1–3) is mounted beneath feet 138 of each cam housing 40, 42 by a pair of longitudinally extending horizontally spaced linear bearings 142. Transfer carriage 140 carries a central upwardly extending yoke 144. The free end of arm 132 is slidably received between the spaced sides of yoke 144. A transfer bar 146, which extends longitudinally along the side of the lower die, carries a plurality of longitudinally spaced hands 148 for engaging workpieces 22. Hands 148 may be of any suitable type. Transfer bar 146 is supported by a pair of longitudinally spaced tubes or arms 150, which are adjustably slidably received within clamps 152 suspended beneath tooling carriage 140.

Figure 3:
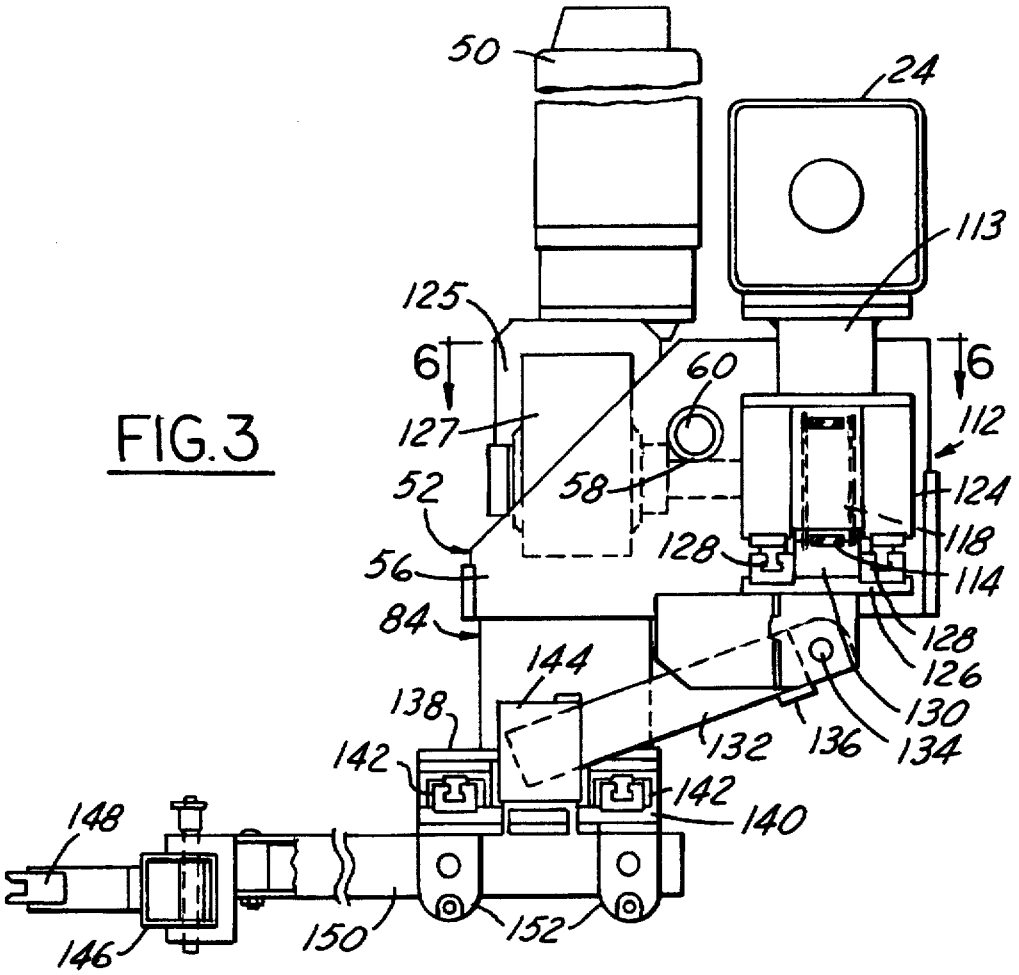
FIG. 3 is an end elevational view of the conveyor in FIG. 2.
Figure 11A:
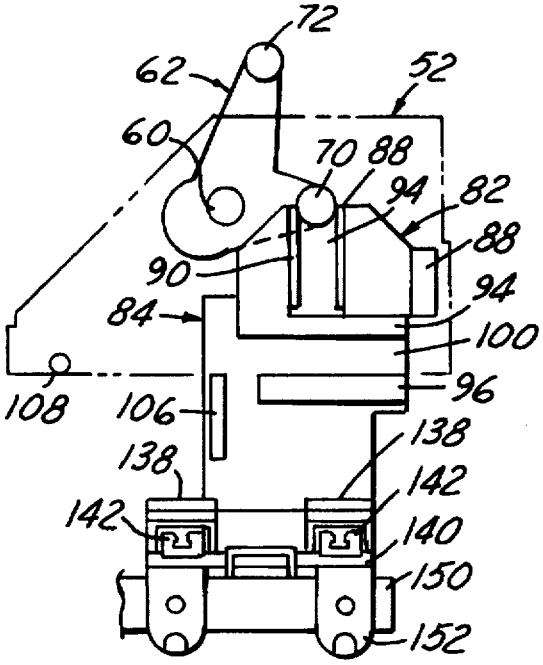
FIGS. 11A–11D are fragmentary views that illustrate motion of the cam arm, cam follower slots and carriages in sequential stages of operation.
Figure 11B:
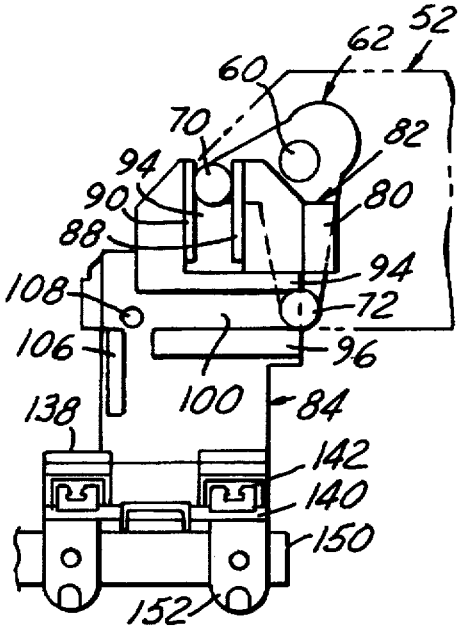
Figure 11C:
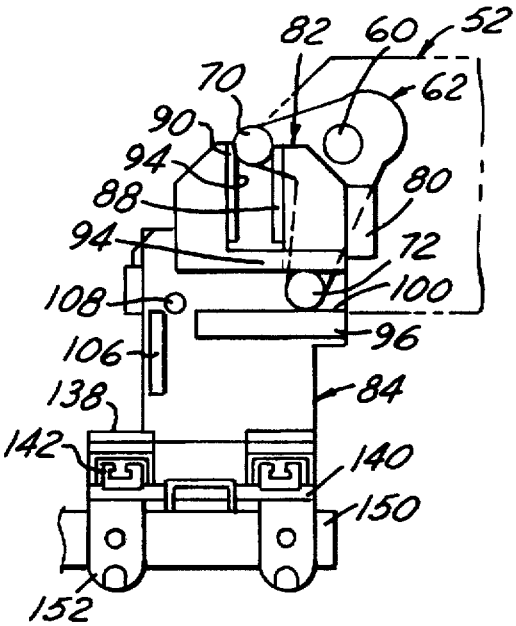

Operation of conveyor 24 will be discussed with particular reference to FIGS. 11A–11D, which illustrates successive stages of the horizontal and vertical drive mechanism within cam housings 40, 42. Initially, camshaft 44 and stub camshaft 60 are in the fully counterclockwise position (FIG. 11A) with horizontal carriage 74, and cam plate 82 fully retracted horizontally outwardly from the lower die, and vertical carriage 84 fully lowered. In this position, vertical carriage 84 is vertically supported by horizontal carriage 74 by means of stop pads 102, 104 (FIGS. 6–10), and horizontal carriage is supported by frame 52 through bearings 76, 78. To activate the conveyor, stub camshaft 60 is first rotated by motor 50 and camshaft 44 clockwise from the position shown in FIG. 11A toward that shown in FIG. 11B. During such motion, cam drive roller 70 enters vertical slot 94 between wear bars 88, 90 (FIG. 11A). Continued clockwise motion of cam arm 62 and roller 70 (FIG. 11A toward FIG. 11B) moves horizontal carriage 74 horizontally inwardly—i.e., toward the lower die—by the force of cam roller 70 on horizontal carriage 74 through wear plate 90, block 92, vertical carriage 84 and linear bearings 86, 87. At the same time, tooling carriage 140, transfer bar 146 and workpiece hands 148 are moved inwardly toward the lower die by the force of roller 70 directly on vertical carriage 84, which carries the tooling carriage. In the position of FIG. 11B, the transfer bar and hands are still in the fully lowered position. The fully inward and fully lowered positions of carriage 140, transfer bar 146 and hands 148 are illustrated in FIGS. 1–3. When shaft 60 and arm 62 are in the position of FIG. 11B, horizontal carriage 74 is fully inward and abuts stop 111 (FIG. 6), and bar 106 on vertical carriage 84 has moved, from the position of FIGS. 7 and 11A to that of FIG. 11B and shown fragmentarily in FIG. 6, beneath and inward of roller 108 on frame 52. There is 180° of rotation of stub camshaft 60 and cam arm 62 between the position of FIG. 11A in which roller 70 is about to enter vertical slot 94, and the position of FIG. 11C in which roller 70 moves out of slot 94. This 180° rotation at the camshaft provides cycloidal motion at the tooling carriage and transfer bar, which inherently slows the transfer bar and hands before engagement with the workpieces. Off-axis shaft 61 provides clearance for movement of vertical carriage 84.

Cam drive roller 72 moves conjointly with cam arm 62 and drive roller 70. In the position illustrated in FIG. 11B, cam drive roller 72 is at a position to enter horizontal slot 100 between wear plates 94, 96 on vertical carriage 84. As roller 72 enters horizontal slot 100 moving in the clockwise direction, continued rotation of arm 62 raises roller 72 against upper wear plate 94 of slot 100, thus raising vertical carriage 84 vertically upwardly with respect to the lower die. Upward force on wear plate 94 lifts vertical carriage 84 vertically upwardly, carrying with it transfer bar 146, hands 148 and workpieces 22 carried thereby. During such upward motion of vertical carriage(s) 84, bar 106 moves upwardly behind roller 108, preventing vertical carriage 84 from moving outwardly during upward motion.

Figure 11D:
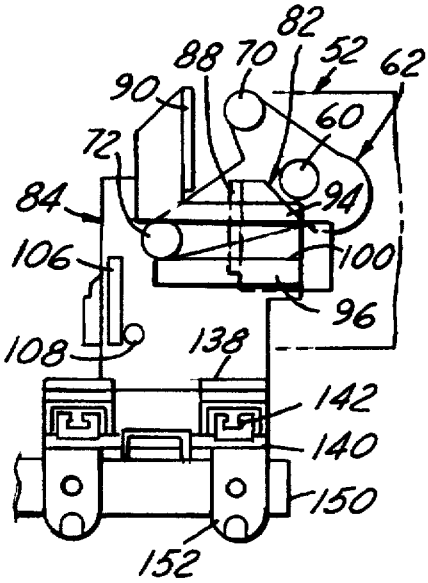

Thus, in the fully raised position illustrated in FIG. 11D, hands 148 are displaced horizontally inwardly and vertically upwardly, supporting workpieces 22 above the lower die surfaces. At this point, indexing conveyor drive 112 is activated by motor 128 to move transfer bar 146 and hands 148 to the left in FIG. 2, so as to index workpieces 22 to the next work stations. Arm 132 functions to transfer motion at drive 112 and transfer carriage 126 to tooling carriage 140 and transfer bar 146. With workpieces 22 positioned over the next work stations, operation proceeds in the reverse direction from the position illustrated in FIG. 11D through those illustrated in 11C and 11B to that illustrated in 11A. That is, stub camshaft 60 is rotated counterclockwise from the position of FIG. 11D to that of FIG. 11C. During such rotation, roller 72 pushes downwardly on wear plate 96, moving vertical carriage 84 downwardly and simultaneously lowering the workpieces onto the lower die surfaces. Continued counterclockwise rotation from the position of FIG. 11C to that of FIG. 11B brings stop bar 106 beneath stop roller 108. Continued counterclockwise rotation from the position of FIG. 11B to that of FIG. 11A brings roller 70 into engagement with wear plate 88 on cam plate 82, and thus moves cam plate 82, bridge 80, horizontal carriage 74 and vertical carriage 84 horizontally outwardly, releasing workpieces 22 over the die stations. In the fully lowered and retracted position of FIG. 11A, indexing conveyor drive 112 may be activated in the reverse direction, or to the right in FIG. 2, so as to reposition transfer bar 146 and hands 148 in their original positions.

Motors 50, 125 are, of course, connected to a suitable motor controller synchronized to motion of the die press ram, as illustrated in above-noted U.S. Pat. No. 5,136,874. All motions are independently programmable. The workpiece hands may include pneumatic or spring-operated grippers, and may rotate the workpieces between work stations, if desired. The space beneath the transfer bar(s) is open for removal of scrap. In the preferred implementation, there are no bolster, shoe, cam or floor-mounted components. Radii of rollers 70, 72 on arm 62 can vary as a function of desired motions and mechanical advantages.

I claim:

1. A die transfer system that includes lower die means, upper die means carried for reciprocal movement toward and away from said lower die means to perform at least one operation on a workpiece positioned therebetween, and means for sequentially conveying workpieces between said die means comprising:

a camshaft having an axis of rotation parallel to the direction of movement of workpieces through said die means, a transfer bar parallel to said axis carrying a plurality of hands for engaging the workpieces, and cam means coupling said camshaft to said transfer bar for moving said transfer bar both horizontally and vertically orthogonal to said axis, characterized in that said cam means comprises:

a cam arm rotatably coupled to said camshaft and having a pair of angularly spaced cam drive rollers mounted thereon, and means forming separate horizontal and vertical cam follower slots adjacent to said cam arm and disposed for sequential driving engagement by said rollers on said arm such that rotation of said camshaft and said cam arm brings said rollers into sequential engagement with said cam follower slots for driving said transfer bar horizontally and vertically with respect to said lower die means.

2. The system set forth in claim 1 wherein said cam means comprises support means, and separate horizontal and vertical carriages carried by said-support means for horizontal and vertical motion respectively, said means forming said separate horizontal and vertical cam follower slots being coupled to said horizontal and vertical carriages such that motion of one of said drive rollers through said vertical slot drives said horizontal carriage horizontally with respect to said lower die means and motion of the other of said drive rollers through said horizontal slot drives said vertical carriage vertically with respect to said lower die means.

3. The system set forth in claim 2 wherein said horizontal and vertical carriages are disposed parallel to each other, one of said carriages being mounted to said support means by first linear bearing means and the other of said carriages being mounted to said one carriage by second linear bearing means orthogonal to said first linear bearing means.

4. The system set forth in claim 3 wherein said horizontal and vertical carriages are coupled to each other and to said support means such that motion of said one roller through said vertical slot drives both of said carriages horizontally, and motion of said other roller through said horizontal slot drives said vertical carriage vertically with respect to both said horizontal carriage and said support means.

5. The system set forth in claim 4 wherein said vertical carriage includes means for engaging said support means to prevent horizontal movement during vertical movement of said vertical carriage.

6. The system set forth in claim 4 wherein said means forming said vertical slot includes opposed slot means on said vertical carriage and coupled to said horizontal carriage such that motion of said one drive roller through said vertical slot in one direction drives said horizontal carriage directly and in the other direction drives said horizontal carriage through said vertical carriage and said second linear bearing means.

7. The system set forth in claim 6 wherein said means forming said horizontal slot includes opposed slot means carried by said vertical carriage.

8. The system set forth in claim 2 wherein said angularly spaced cam drive rollers are disposed at differing radii on said cam arm.

9. The system set forth in claim 2 wherein said cam means further includes a tooling carriage supported by one of said horizontal and vertical carriages, and means mounting said transfer bar for longitudinal motion with said tooling carriage parallel to said axis.

10. The system set forth in claim 9 wherein said conveying means further comprises transfer drive means operatively coupled to said transfer bar for moving said transfer bar longitudinally parallel to said axis.

11. The system set forth in claim 10 wherein said transfer drive means includes means coupling said transfer drive means to said transfer bar for driving said transfer bar longitudinally while accommodating horizontal and vertical motion of said transfer bar orthogonal to said axis.

12. The system set forth in claim 11 wherein said coupling means comprises an arm pivotally coupled to said transfer drive means and a yoke carried by said tooling carriage embracing said arm.

* * * * *